US006102752A

United States Patent [19]

Bommel et al.

[11] Patent Number: 6,102,752

[45] Date of Patent: Aug. 15, 2000

[54] TWO-PART ELECTRICAL SOCKET CONTACT

[75] Inventors: Christian Otto Bommel, Langen; Rolf Jetter, Darmstadt, both of Germany

[73] Assignee: The Whitaker Corporation, Wilmington, Del.

[21] Appl. No.: 09/328,267

[22] Filed: Jun. 21, 1999

[30] Foreign Application Priority Data

Jun. 29, 1998 [DE] Germany ..... 198 28 984

[51] Int. Cl.[7] ..... H01R 13/187

[52] U.S. Cl. ..... 439/845; 439/852

[58] Field of Search ..... 439/845, 851, 439/842, 843, 852, 856

[56] References Cited

U.S. PATENT DOCUMENTS

| | | | |
|---|---|---|---|
| 5,188,545 | 2/1993 | Hass et al. | 439/851 |
| 5,295,875 | 3/1994 | McCardell | 439/851 |
| 5,334,058 | 8/1994 | Hotea | 439/851 |
| 5,342,226 | 8/1994 | Hayes et al. | 439/845 |
| 5,607,328 | 3/1997 | Joly | 439/852 |
| 5,947,777 | 9/1999 | Chaillot et al. | 439/852 |
| 5,989,078 | 11/1999 | Chaillot et al. | 439/851 |

FOREIGN PATENT DOCUMENTS

| | | | |
|---|---|---|---|
| 0 667 891-A1 | 10/1995 | European Pat. Off. | H01R 13/422 |
| 0 727 842-A2 | 8/1996 | European Pat. Off. | H01R 13/115 |
| 3-93176 | 4/1991 | Japan | H01R 13/11 |

*Primary Examiner*—Renee Luebke
*Assistant Examiner*—T. C. Patel

[57] ABSTRACT

A two-part electrical socket contact for insertion into a cavity of a housing the cavity having a flexible contact securing element, said contact being provided with a contact body comprising a contact making section for making contact with a complementary contact pin or contact blade, and a connecting section for making connection with an electrical conductor, the contact making section being provided with at least two facing contact springs, and an outer cantilever spring enveloping the contact making section of the contact body, the outer cantilever spring being basically of a box-shaped design comprising a top, a bottom and two sides, the top of the outer cantilever spring consisting of a lower and an upper layer with the upper layer running parallel but spaced apart from the lower layer, and being provided with an opening to accommodate the contact securing element and the edges of the upper layer being bent over at right angles towards the lower layer and with the upper layer being narrower in its width perpendicular to the plugging direction than the lower layer.

7 Claims, 5 Drawing Sheets

A–A

A-A

A-A
1
2
3
8
9
27
A

A-A

B-B

B-B

C-C

A-A

TWO-PART ELECTRICAL SOCKET CONTACT

BACKGROUND OF THE INVENTION

1. Field of the Invention

This invention relates to a two-part electrical socket contact.

2. Description of the Prior Art

In many applications of electrical contacts such as in the automotive industry, one of the requirements is that the electrical contact can be inserted through a family seal into a cavity within a housing. Inside the cavity, such an electrical socket contact can, for instance, be secured by means of a flexible contact securing element provided in the cavity. One fundamental problem is that the family seal must not be damaged by the socket contact when inserted through the seal.

It is standard practice to produce electrical contacts from sheet metal by stamping and forming with the electrical contacts being of one or two parts. The electrical contacts feature contact springs to make contact with a complementary contact pin or blade. The contact springs are often supported by supporting elements in order to increase the spring action.

EP-A-727 842 for instance, discloses a single piece socket contact produced by stamping and forming that is designed to be inserted into the cavity of a housing. Inside the cavity, the contact is secured by a flexible contact securing element provided in the cavity. The socket contact features a contact body with a contact making section for making contact with a complementary contact pin or blade and a connecting section for making connection with an electrical conductor. The contact making section is provided with a contact spring on each of the two opposite sides. The contact making section of the contact body is surrounded by an outer, cantilever spring which has been formed out of one piece of sheet metal. The outer cantilever spring is typically box-shaped with a top, a bottom and two sides, the top and bottom each being provided with a support element to support the contact spring of the contact body. In addition, one of the sides is provided with an opening to accommodate the contact securing element. The outer cantilever spring is without any outwardly protruding sharp edges to assure that the contact will be inserted through a seal without damaging the seal. If the contact securing element of the housing is disposed on a side of the socket contact on which the support element is also located, then the contact discussed in EP 727 842-A2 cannot be inserted into such a cavity or be altered for such a cavity.

U.S. Pat. No. 5,295,875 discloses a two-part electrical socket contact which can be inserted through a family seal without difficulties. This contact is also intended to be inserted into a housing provided with a cavity having a flexible contact securing element. The contact consists of a contact body having a contact making section and a connection end with. The contact making section is provided, on at least two opposite sides, with a contact spring. The electrical socket contact is further provided with an outer cantilever spring which surrounds the contact making section of the contact body. The outer cantilever spring is of a cylindrical shape and is provided with a circumferential shoulder which the contact securing element positively engages.

SUMMARY OF THE INVENTION

It is the object of the invention to produce a two-part electrical socket contact for insertion in a cavity of a housing that is provided with a flexible contact securing element where the contact can be inserted without difficulty through the opening of a family seal and the contact provides a means for polarisation relative the cavities of the housing.

The object is achieved by a two-part electrical socket contact which is to be inserted into a cavity of a housing, the cavity comprising a flexible contact securing element. The socket contact comprises a contact body consisting of a contact making section for making contact with a complementary contact pin or contact blade and a connecting section for the connection with an electrical conductor, with the contact making section being provided with a contact spring on each of two opposite sides and with an outer cantilever spring surrounding the contact making section of the contact body, with the outer cantilever spring being typically of a box-type design comprising a top, bottom and two sides, with the top and bottom each being provided with a support element for the support of the contact spring of the contact body, with the top of the outer cantilever spring consisting of a lower and a raised layer. The lower layer incorporates the support element whereas the raised layer runs parallel to the lower layer and is provided with an opening to accommodate the contact securing element with the edges of the raised layer typically having been bent over at right angles towards the lower layer, with the raised layer being narrower than the top in the direction perpendicular to the plugging direction.

The doubling arrangement at the top allows for both the provision of a contact arm and the contact securing element on the same side of the electrical contact, where the contact securing element extending from this side into the socket contact.

It is particularly advantageous that the contact is suitable for insertion through a family seal. This is achieved by bending over the edges of the raised layer of the top at right angles towards the lower layer thus avoiding sharp edges. Another measure to prevent sharp edges comes from the fact that the socket contact at its mating end is tapered towards the front.

Furthermore it is of particular advantage that the outer cantilever spring is provided with elements for polarising the contact in the cavity. This is achieved by having a raised layer of the top which is narrower in the width, perpendicular to the plugging direction, than the width of the lower layer of the top. This creates a step in the top which can be used for polarising purposes.

Moreover it is of particular advantage that, depending on the application, different support elements can be provided in the cantilever spring. The obvious choice for support elements are symmetrical leaf springs in the top and bottom of the cantilever spring or else a leaf spring in only one of the two sides and an embossing element in the opposite side.

Furthermore it is of particular advantage that a minimum gap between the contact springs is maintained by restricting elements. The restricting elements can be designed in such a way that a portion of the outer cantilever spring, which is situated between the contact springs, is bent inwards, or that the contact springs themselves are provided with partially bent over portions at their sides thus bearing against each other.

DETAILED DESCRIPTION OF THE PREFERRED EMBODIMENT

Figures 1, 2, 3, 4:
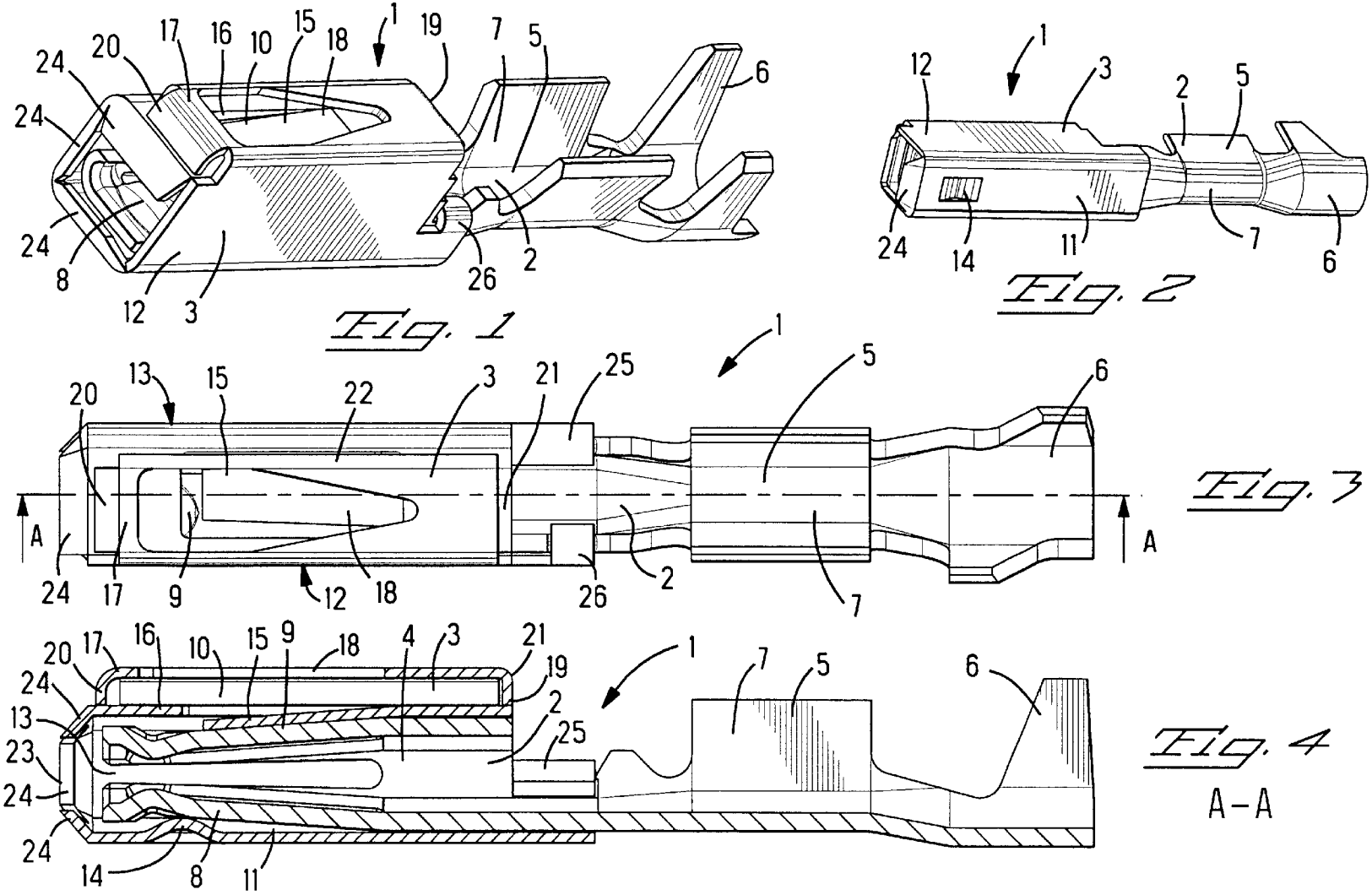
FIG. 1 is an isometric view of a socket contact showing in particular the mating end, the top and one side.
FIG. 2 is also an isometric view of the contact showing one side and the bottom.
FIG. 3 is a plan view on the top of the electrical socket contact.
FIG. 4 is a cross-sectional view through an electrical socket contact along section line AA according to FIG. 3.
Figures 5, 6, 7, 8:
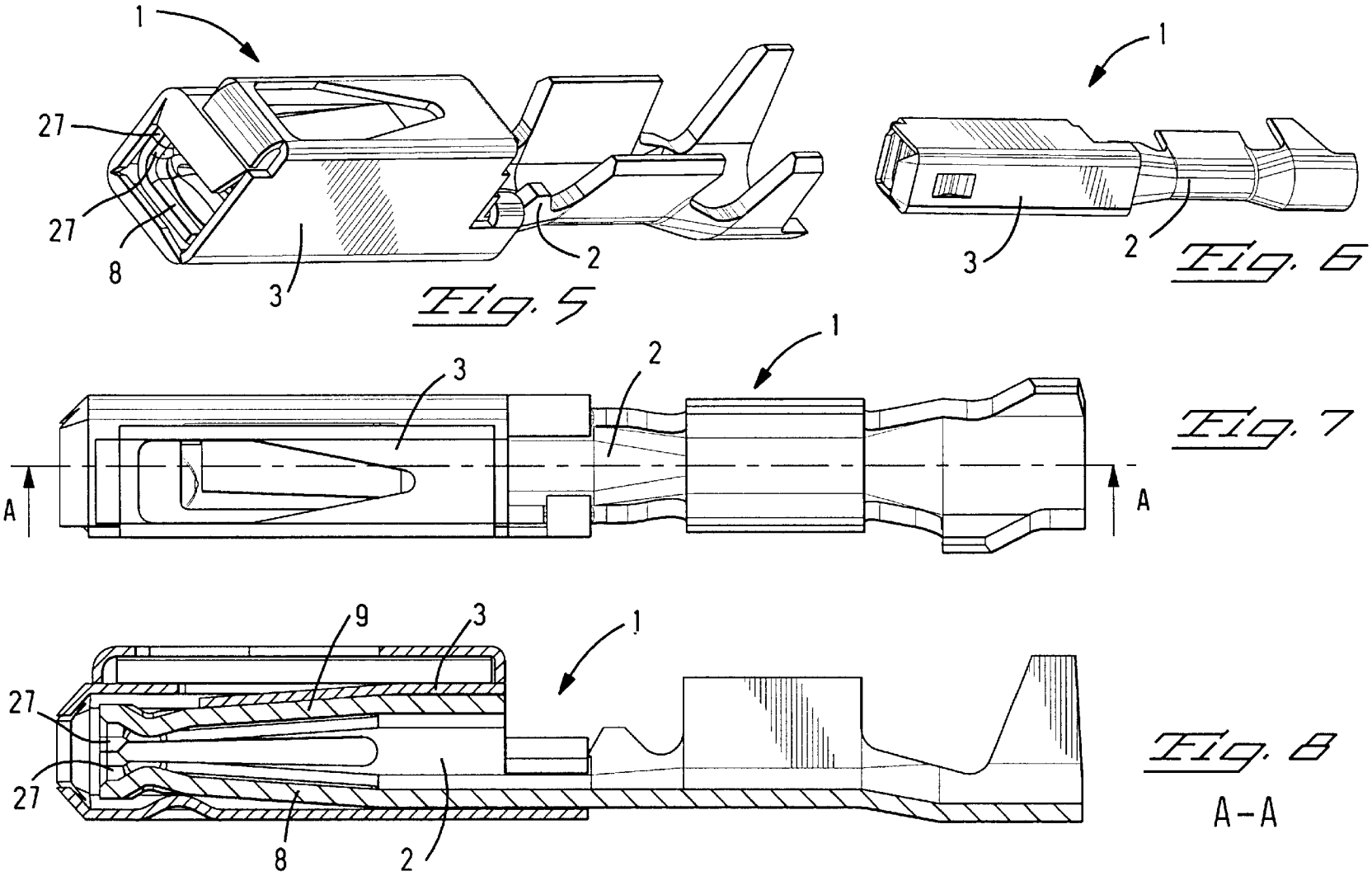
FIG. 5 is an isometric view of a second embodiment of an electrical socket contact showing the mating end, the top and one side in particular.
FIG. 6 is an isometric view of the respective socket contact from below.
FIG. 7 is an isometric view of the respective socket contact from the top showing the top side in particular.
FIG. 8 is a sectional view of the socket contact along the section line AA as indicated in FIG. 7.
Figure 10:
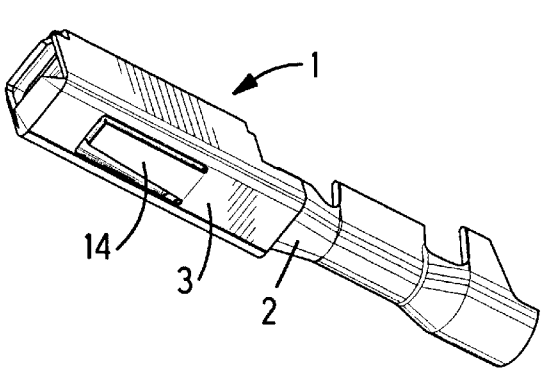
FIG. 10 is also an isometric view of the respective socket contact from below.
Figure 9:
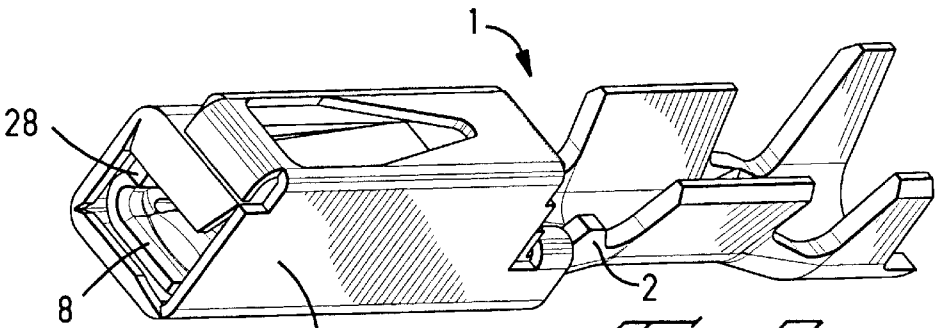
FIG. 9 is an isometric view of another embodiment example of the electrical socket contact showing clearly the mating end, one side and the top.
Figure 11:
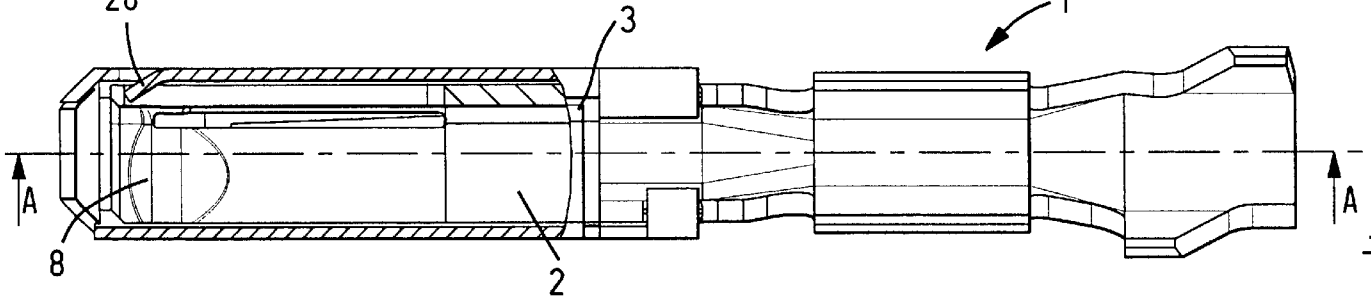
FIG. 11 is a part sectional side elevation view of the respective socket contact.
Figure 12:
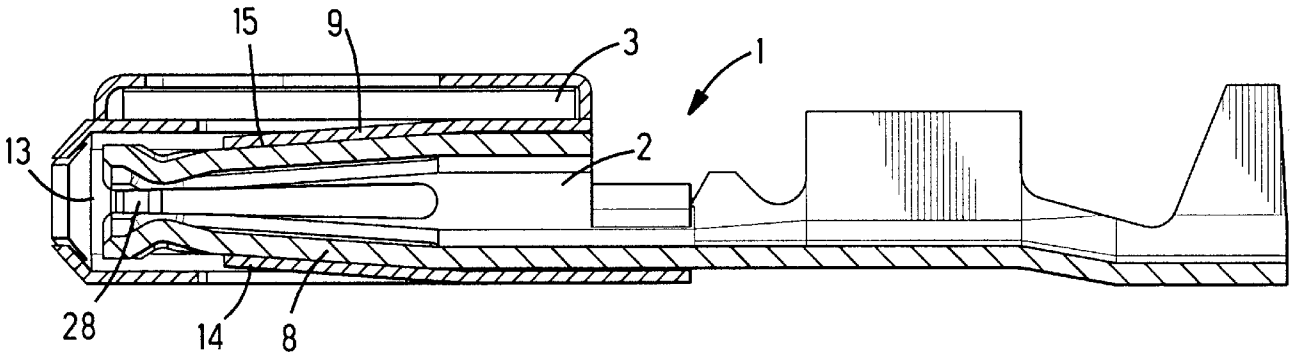
FIG. 12 is a cross section through the socket contact along section line AA according to FIG. 11.
Figure 13:
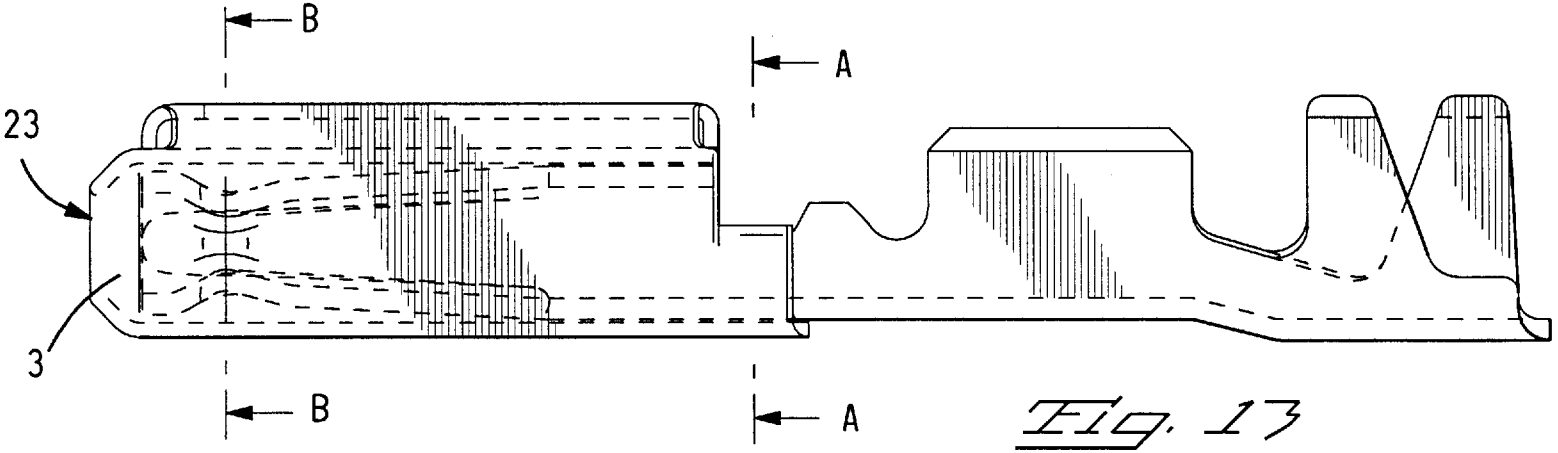
FIG. 13 is a side elevation view of a further embodiment of an electrical socket contact.
Figure 14:
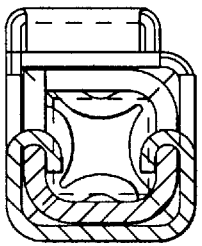
FIG. 14 is a cross-sectional view through the electrical socket contact along the section line AA according to FIG. 13.
Figure 15:
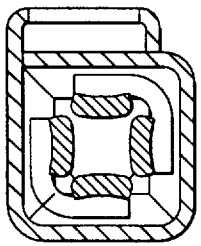
FIG. 15 is a cross-section view through the electrical socket contact along the section line BB according to FIG. 13.
Figure 23:
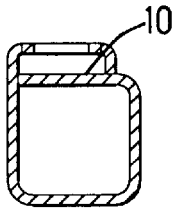
FIG. 23 is a section through the outer cantilever spring along the section line BB according to FIG. 21.
Figure 16:
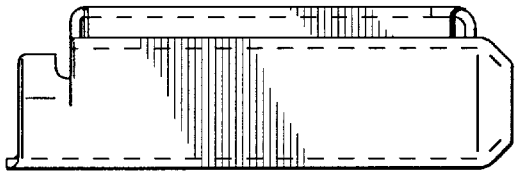
FIG. 16 is a side elevation of the outer cantilever spring of the electrical socket contact according to FIG. 13.
Figure 19:
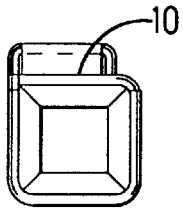
FIG. 19 is a view from the cable end of the outer cantilever spring.
Figure 20:
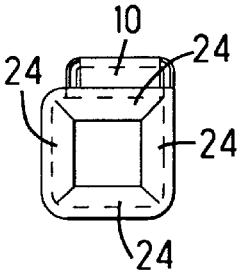
FIG. 20 is a view from the plug end of the outer cantilever spring.
Figure 21:
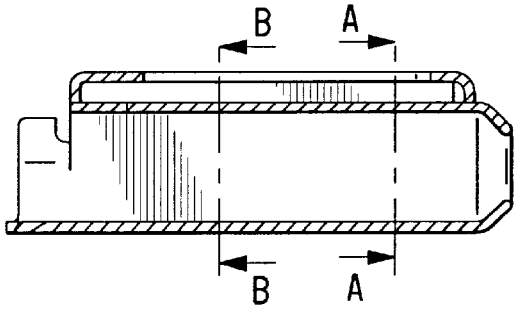
FIG. 21 is a cross-sectional view through the outer cantilever spring along section line CC according to FIG. 18.
Figure 22:
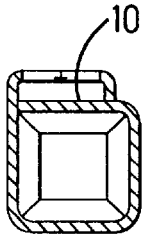
FIG. 22 is a section through the outer cantilever spring along the section line AA according to FIG. 21.
Figure 18:
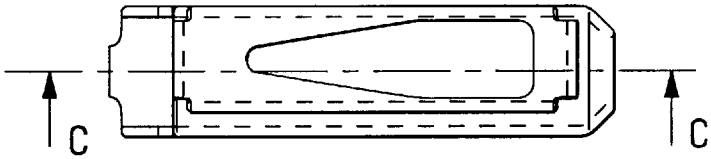
FIG. 18 is the plan view on the top of the outer cantilever spring.
Figure 17:
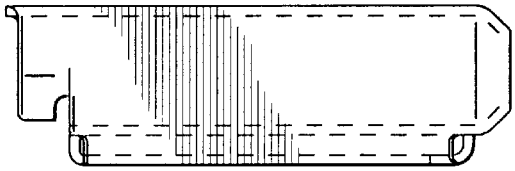
FIG. 17 is a corresponding view from the other side of the outer cantilever spring.

With the aid of FIGS. 1 to 4 a first embodiment of an electrical socket contact 1 is now to be described. The electrical socket contact 1 is suitable for being inserted into a cavity of a housing (not shown), the cavity having a flexible contact securing element. Usually each cavity includes a contact securing element. The contact securing element normally takes the form of a flexible plastic arm with a lug at its free end. The function of the contact securing element is to secure the electrical contact in the cavity of the housing. Such a first contact securing element is often combined with a second movable contact securing arrangement.

The socket contact 1 as shown in FIGS. 1 to 4 is provided with a contact body 2 and an outer cantilever spring 3. The contact body 2 has a contact making section 4 and a connecting section 5. The connecting section 5 is designed as a crimp connection. It is provided with an insulation crimp 6 for the fastening of the socket contact 1 to the insulation of an electrical conductor (not shown) and with a conductor crimp 7 for fastening to the electrical conductor and for making contact with the same. The connecting section 5 is followed by the contact making section 4 of the contact body 2. The contact making section 4 is used to make contact with a complementary contact pin or contact blade (not shown). The contact making section 4 is provided with two opposing contact springs 8, 9.

The contact making section 4 of the contact body 2 is enveloped by the outer cantilever spring 3. The spring 3 is essentially box-shaped having a top 10, bottom 11 and two sides 12, 13. Top 10 and the bottom 11 are each provided with a support element 14, 15 for the support of the contact spring 8, 9 of the contact body 2. The top 10 further includes a raised layer 17 and a lower layer 16 of sheet metal. The lower layer 16 is provided with the support element 15. The raised or upper layer 17 runs parallel to the lower layer 16 but is spaced apart therefrom. The raised layer 17 is provided with an opening 18. The opening 18 is tapered towards a cable end 19 of the outer cantilever spring 3. The function of the opening 18 is to accommodate the contact securing element of the housing.

In order to obtain a smooth outer surface of the outer cantilever spring 3 to enable the insertion of the contact 1 into a family seal, the edges 20, 21, 22 of the raised layer 17 of the top 10 are bent down at right angles toward the lower layer 16. In addition, the raised layer 17 is narrower in its width, perpendicular to the plugging direction, than the top 10. This is illustrated in FIG. 3. This structure produces a step in one corner of the cross-section of the electrical socket contact, thereby making polarisation possible relative the respective housing cavities.

The design of the support elements 14, 15 in the first embodiment is as follows: The support element 14 which supports the contact spring 8 in the bottom 11 takes the form of an embossed element. By contrast, the support element 15 which supports contact spring 9 in the top 10 takes the form of a leaf spring.

The mating end 23 of the outer cantilever spring 3 is provided with lugs 24 bent in the inward direction so that the socket contact tapers towards the mating end. To secure the outer cantilever spring 3 to the contact body 2, securing lugs 25 and 26 are provided at the cable end 19 of the outer cantilever spring 3 which are bent over corresponding parts of the contact body 2 to secure the outer cantilever spring 3 to the same.

Referring now to FIGS. 5 to 8, a second embodiment of the socket contact will now be explained. This example is essentially the same as the one according to FIGS. 1 to 4. The only difference is that the facing contact springs 8, 9 at the mating end are provided with portions 27 that are bent over sideways thus bearing on each other and determining the minimum gap between the contact springs 8,9. The description of FIGS. 1 to 4 can otherwise be also applied to FIGS. 5 to 8.

A third embodiment according to FIGS. 9 to 12 also differs only marginally from the embodiment of FIGS. 1 to 4. Here too, elements 28 for restricting the minimum gap between the contact springs 8,9 are provided. Here the elements consist of a lug 28 bent from side 13 of the outer cantilever spring 3 into the inner cavity of the outer cantilever spring. This lug 28 restricts the movement of the contact springs 8,9 towards each other by acting as a stop. A further difference from the embodiment according to FIGS. 1 to 4 is that the support elements 14, 15 are both of the leaf spring type, thus providing a particularly symmetrical support for the contact springs 8,9.

Referring to FIGS. 13 to 23 a fourth embodiment of the socket contact will now be discussed. This socket contact differs substantially in that it provides a different contact making section from the embodiments discussed so far but also in that there are no support elements provided for the support of the contact springs. Otherwise the design corresponds to the configuration discussed in connection with FIGS. 1 to 4. A further difference is the symmetrical tapering at the mating end 23 of the outer cantilever spring 3 since bent over lugs 24 are provided on all sides. FIGS. 19, 20, 22 and 23 show clearly how the doubled up top section 10 can contribute to the desired polarisation of the contact.

I/we claim:

1. A two-part electrical socket contact for insertion into a cavity of a housing, the cavity having a flexible contact securing element, said contact comprising a contact body having a contact making section adapted to make contact with a complementary contact pin or contact blade and a connecting section for connecting to an electrical conductor, the contact making section having on at least two facing sides, a contact spring, and the contact making section being enveloped by an outer cantilever spring, the outer cantilever spring being of box-shaped design having a top, a bottom and two sides with the top of the outer cantilever spring having two layers, a lower layer and an upper layer, the upper layer running parallel to but spaced apart from the lower layer and having an opening to accommodate the contact securing element and the upper layer having edges that are bent over towards the lower layer, and the upper layer being narrower in width in a direction perpendicular to the plugging direction than the lower layer.

2. The two-part electrical socket contact according to claim 1, wherein the top and the bottom are each provided with a support element for the contact spring of the contact body and in that the lower layer of the top is provided with a support element.

3. The two-part electrical socket contact according to claim 2, wherein one of the support elements in the top and bottom takes the form of a leaf spring and the other the form of an embossing element.

4. The two-part electrical contact according to claim 2, wherein the support elements in the top and bottom take the shape of leaf springs.

5. The two-part electrical contact according to claim 1, wherein the outer cantilever spring is provided with bent over lugs at the mating end, the lugs are bent towards the mating end, thereby providing a tapered end to the socket contact.

6. The two-part electrical contact according to claim 1, wherein a lug is bent out of at least one side of the outer cantilever spring to extend between the contact springs in order to determine a minimum gap between the contact springs.

7. The two-part electrical contact according to claim 1, wherein the contact springs are provided with bent over portions which rest against each other thereby determining a minimum gap between the contact springs.

* * * * *